US005566137A

United States Patent [19]

Chevroulet et al.

[11] Patent Number: 5,566,137

[45] Date of Patent: Oct. 15, 1996

[54] WATCH COMPRISING A DISPLAY ARRANGEMENT ASSOCIATED WITH AN OPTICAL ENLARGING DEVICE

[75] Inventors: Michel A. Chevroulet, Neuchâtel; Jean-Michel Mayor, Yverdon-Les-Bains; Viron Teodoridis, Hauterive, all of Switzerland

[73] Assignee: Centre Electronique Horloger S. A., Neuchatel, Switzerland

[21] Appl. No.: 503,030

[22] Filed: Jul. 17, 1995

[30] Foreign Application Priority Data

Jul. 21, 1994 [CH] Switzerland ..... 2 309/94

[51] Int. Cl.[6] ..... G04C 19/00

[52] U.S. Cl. ..... 368/82; 368/249

[58] Field of Search ..... 368/10, 276, 278, 368/294–296, 309, 76, 80, 82–84, 239–242

[56] References Cited

U.S. PATENT DOCUMENTS 3,650,599 3/1972 Pedersen ..... 350/113

4,451,117 5/1984 Goode ..... 350/114

FOREIGN PATENT DOCUMENTS 346178 4/1960 Switzerland .

368756 4/1963 Switzerland .

*Primary Examiner*—Vit W. Miska

*Attorney, Agent, or Firm*—Griffin, Butler, Whisenhunt & Kurtossy

[57] ABSTRACT

A watch (31) comprises an horological movement (32) associated with a liquid crystal display arrangement (34) located under the crystal (8) of such watch. The watch (31) comprises an active display arrangement (36) located within the watch case (4). In addition, the watch comprises a mirror (40) arranged in the back cover (6) of the watch and an enlarging lens (38) arranged under the crystal (8). The optical elements are arranged so that the light coming from the active display arrangement (36) is reflected by the mirror (40) in the direction of the enlarging lens (38).

12 Claims, 5 Drawing Sheets

WATCH COMPRISING A DISPLAY ARRANGEMENT ASSOCIATED WITH AN OPTICAL ENLARGING DEVICE

FIELD OF THE INVENTION

The present invention concerns a watch comprising an information display arrangement and an optical enlarging device in such display arrangement for the eye of a user of such watch.

BACKGROUND OF THE INVENTION

In order to display information, it is known to use in a watch, either an analog display generally formed of hands associated with one or several graduations, or a digital display formed generally by cells of liquid crystals (LCD).

It is also known to use a printed disc or ring associated with an aperture provided in the dial of the watch in order to indicate the date, the day of the week, the month or indeed the year. In order to enlarge the number indicating the date, it is known to arrange-an enlarging lens at the level of the watch crystal opposite the aperture provided in the dial. In such a case, the distance separating the printed disc or ring and the enlarging lens is generally less than 3 mm. Because of this, the focal length of the lens must be very small in order to enable a substantial enlargement. For example, in order to obtain an enlargement by a factor of 2, the focal length is less than 6 mm. Admitting that the aperture has a radius 1 mm and that the eye is about 15 cm from the watch crystal, the enlarging lens must have a radius of approximately 2 mm corresponding to the radius of the virtual image formed by such enlarging lens in order that the date can be read in its entirety by a watch user.

Additionally, with a lens having a focal length of 6 mm, the edge effects are very substantial and the optical aberrations are enormous to an extent such that an enlarging lens having a radius of a dimension substantially double, that is to say on the order of 4 mm, is necessary in order to read the date correctly and easily which is enormous for a focal length of 6 mm.

The above-mentioned arrangement is very unfavourable as far as concerns the overall dimensions of the enlarging lens and the quality of the image formed by such lens remains relatively mediocre. Consequently, the arrangement described hereinbefore is appropriate only for enlargements substantially less than a factor of two. Thus, this arrangement does not permit a substantial increase in the density of information supported by the display arrangement.

The problem set forth hereinbefore demonstrates that in the case in which information is displayed at the dial level, the possibilities of augmenting such information in a significant manner whilst furnishing an enlarged image of good quality enabling easy reading of such information do not exist for watches having conventional dimensions and particularly for wristwatches.

SUMMARY OF THE INVENTION

The present invention proposes to solve this problem in providing a watch comprising information display means, capable of having a high information density, associated with an optical enlarging device arranged in the watch in a manner to permit an enlargement of such display means sufficient to guarantee easy reading of such information.

By way of example, a text of ten lines having a length of line corresponding to about fifteen characters can be displayed by a matricial arrangement having 100×100 pixels. By pixel is understood a localized and substantially uniform information item, in particular an emission of light by a cell, for example a light emitting diode or an integrated micro-laser.

In order to read directly the above-mentioned text at a distance of about 20 cm, it is necessary that the matricial arrangement mentioned above have a surface of about 4 $cm^2$ in order to assure easy reading. It will be noted that a direct display of 4 $cm^2$ occupies about the whole of the dial of a wristwatch dimensioned for the arm of a man. This limits considerably the possibilities of layout of such dial.

The present invention also has as purpose to furnish a watch capable of having a matricial display of about 100×100 pixels capable of being correctly read by a user of the watch, whilst having a surface for the reading of such matricial display less than 4 $cm^2$, for example from 1 to 2 $cm^2$, provided on the dial of such watch.

The present invention has as object a watch comprising a case, display means and optical enlarging means arranged so as to optically enlarge information furnished by said display means for a user of such watch, such watch being characterized in that it furthermore comprises a first mirror arranged within said case in order to reflect light coming from said display means in the direction of said optical enlarging means, said display means being likewise arranged within said case.

There results from the characteristics of the watch according to the invention that the length of the optical path separating the display means from the optical enlarging means can be relatively great, in particular with a dimension greater than the thickness of the watch itself, thanks to the first mirror enabling reflection of the light coming from the display means, in the direction of the optical enlarging means.

In a specific embodiment, the first mirror is arranged in the back cover of the case and the optical enlarging means comprise a first enlarging lens arranged under the crystal of the watch. Thus, the length of the optical path between the display means and such first lens can, without further, be greater than the thickness of the watch as such will appear to still better advantage upon reading of the detailed description of the various embodiments which are to follow.

Likewise, other characteristics and advantages of the invention will be better understood hereinafter with the help of the following description prepared having reference to the drawings intended to be in no manner limiting.

DESCRIPTION OF PREFERRED EMBODIMENTS

Figure 1:
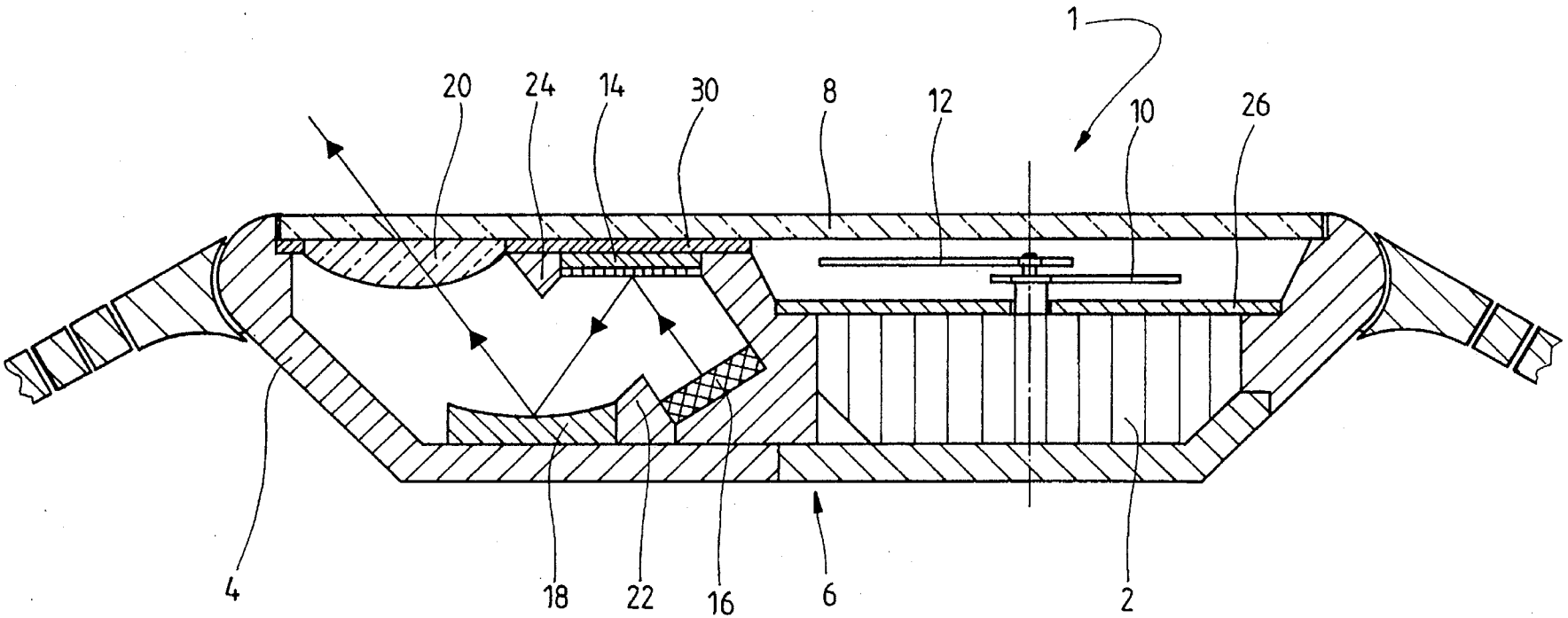
FIG. 1 shows a schematic cross-section of a watch according to a first embodiment of the invention.
Figure 2:
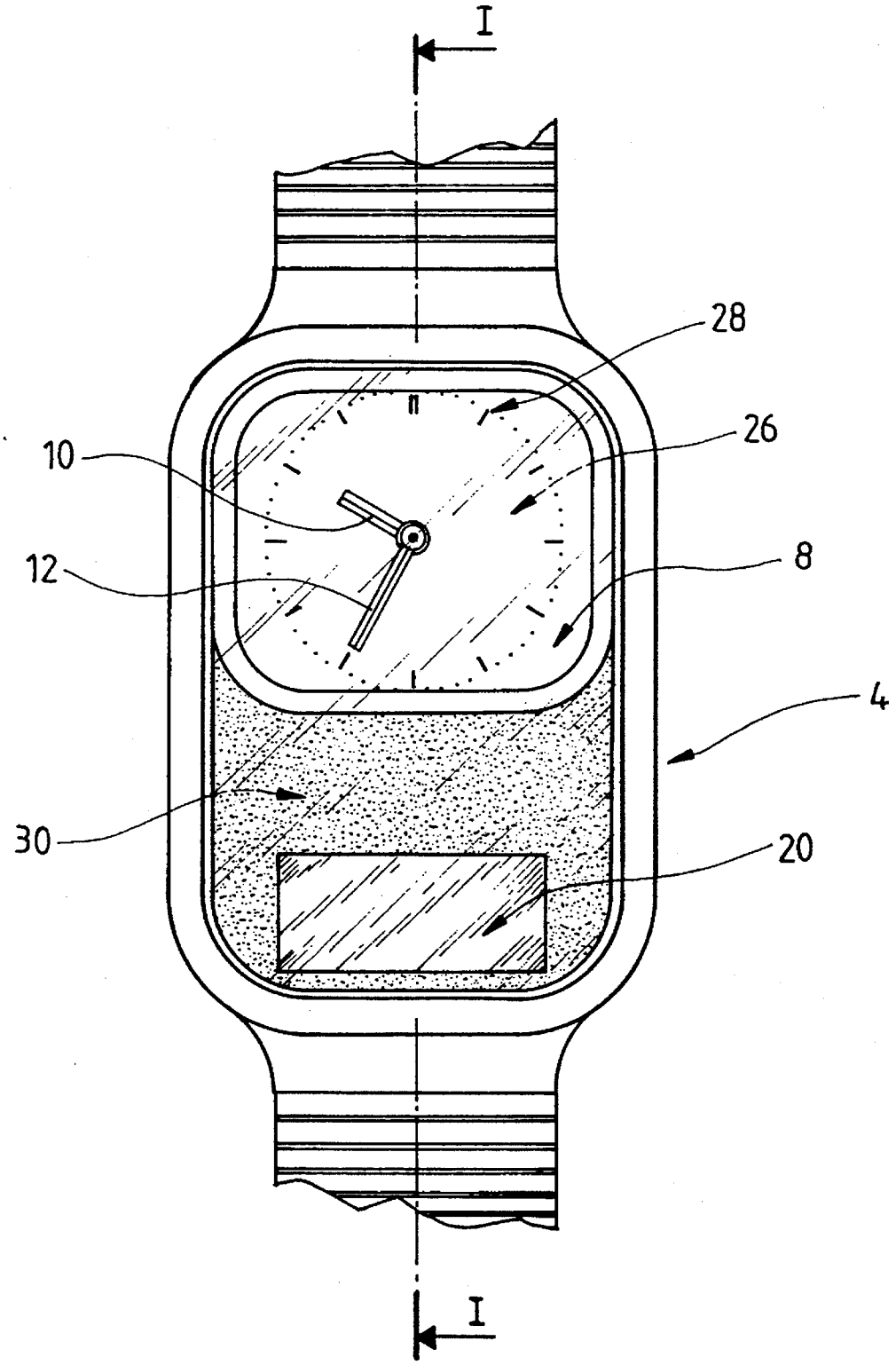
FIG. 2 shows a schematic view from above of the watch shown on FIG. 1.

Hereinafter there will be described, with the help of FIGS. 1 and 2, a first embodiment of a watch according to the invention.

Watch 1 comprises an horological movement 2 arranged in a case 4. Case 4 comprises a back cover 6 and a crystal 8. The horological movement 2 is associated with an analog time display comprising an hours hand 10 and a minutes hand 12. Within the case 4 are arranged a micro-shutter display arrangement 14, a light source 16, a mirror 18 and an enlarging lens 20.

The light source 16 is capable of sending light in the direction of the micro-shutter display arrangement 14. This latter is arranged in a manner to reflect the light coming from the light source 16 in the direction of mirror 18, which is arranged so as to reflect the light coming from arrangement 14 in the direction of the enlarging lens 20. The light coming thus from the micro-shutter display arrangement 14 comes out of the case 4 in passing through crystal 8. Within case 4 are also comprised internal parts 22 and 24 serving basically to prevent the light furnished by the light source 16 from coming out directly from case 4 through the enlarging lens 20 without having been reflected by the micro-shutter display arrangement 14 and mirror 18.

Here it will be noted that light source 16 can be either a monochromatic light source or a polychromatic light source. Next, mirror 18 is either a spherical mirror or an aspherical mirror serving to correct the optical aberrations of the enlarging lens 20. An aspherical mirror is optically more advantageous than a spherical mirror given that it basically enables elimination of the optical aberrations normal to spherical optical elements. In another embodiment, there is provided a plane mirror.

In this first embodiment, the enlarging lens 20 is a standard lens having a certain focal length. By way of example, the focal length of lens 20 is 20 mm and the optical distance separating the microshutter display arrangement 14 and such enlarging lens 20 is 15 mm. By appropriate dimensioning of the arrangement 14, mirror 18 and the enlarging lens 20, easily accomplished by a person skilled in the art, the enlarging lens 20 forms a virtual image of the micro-shutter display arrangement 14 corresponding approximately to an enlargement by a factor 4 for the eye of a user located substantially at a distance of 20 cm from said virtual image, relatively to the case of a liquid crystal display of known type located likewise at 20 cm from the eye of a user. Thus, it appears clearly that the layout of the various optical elements 14, 18 and 20 enables the obtaining of a relatively great enlargement of a display arrangement with the help of an enlarging lens having a focal length greater than 10 cm. Thereby, the micro-shutter display arrangement 14 can give high surface density information which could not be read directly by an eye having normal visual acuity without necessitating an intense accommodation effort.

In a first variant, the enlarging lens 20 is a spherical lens. In a second variant, the enlarging lens 20 is a cylindrical lens enabling an enlargement of the micro-shutter display arrangement 14 along a single dimension. In this latter case, mirror 18 also exhibits cylindrical symmetry.

The obtaining of the micro-shutter display arrangement 14 will not be described here in detail, given that such arrangement itself does not form the object of the present invention.

It will be noted that watch 1 comprises a first dial 26 including at its surface graduations 28 for the indication of the time of day. Furthermore, watch 1 comprises a second dial 30 located against crystal 8 or in proximity to such crystal 8 and serving in particular for the layout of arrangement 14 and of the enlarging lens 20. In a first variant, the enlarging lens 20 is glued against the inner surface of crystal 8. In a second variant, the enlarging lens 20 is directly formed in crystal 8.

Mirror 18 arranged at the back cover 6 side of case 4 and the micro-shutter display 14 arranged at the crystal 8 side of watch 1 enable increasing the optical distance separating the display arrangement 14 and the enlarging lens 20. Thereby it is possible to obtain a relatively great enlargement with an enlarging lens having a relatively long focal length, which permits diminishing the space requirement of the enlarging lens and diminishing the optical aberrations generated by such enlarging lens. In addition, the optical arrangement mentioned above enables the use of an enlarging lens 20 exhibiting dimensions which are sufficient to guarantee correct and easy reading of the micro-shutter display arrangement enlarged by such enlarging lens 20.

It will nevertheless be noted that the first embodiment of the invention described hereinbefore does not resolve in an optimum manner the question of space occupied by the standard optical elements 18 and 20 and the question of the optical quality of the virtual image of the micro-shutter display arrangement formed by the enlarging lens 20. When a correcting lens is provided, the problem of space is further aggravated.

The present invention also has as purpose to resolve the problem of space occupied by the various standard optical elements of the first embodiment described hereinbefore, and to increase the quality of the enlarged image of the display arrangement.

To this effect, the present invention proposes hereinafter other embodiments.

With the help of FIG. 3, there will be described hereinafter a second embodiment of the invention.

Figure 3:
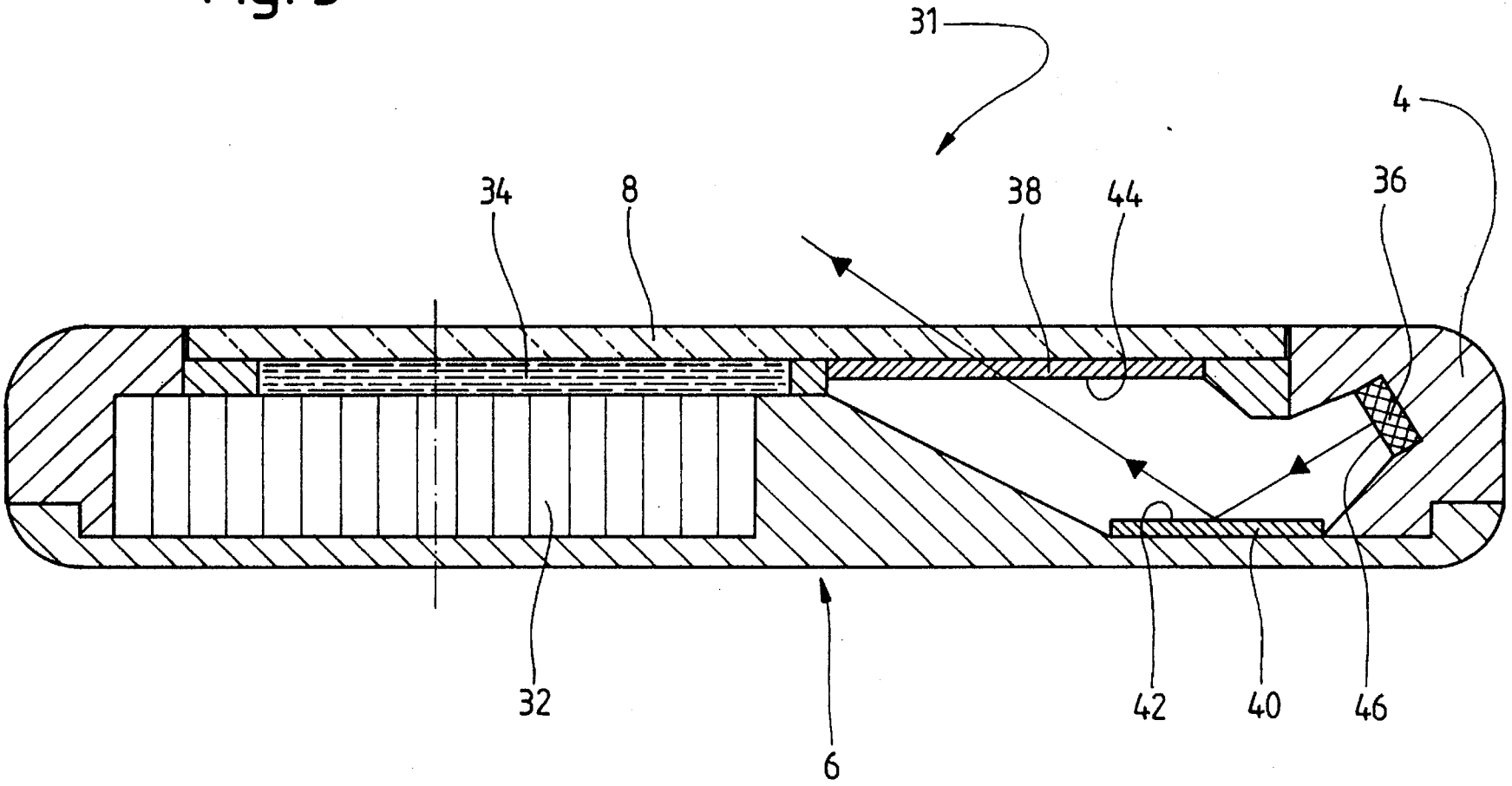
FIG. 3 is a schematic cross-section view of a watch according to a second embodiment of the invention.

On such FIG. 3 is shown in cross-section a watch 31 comprising an horological movement 32 associated with a liquid crystal display arrangement 34 located under the watch crystal 8. Watch 31 also comprises a case formed from a caseband 4 and a back cover 6. Within the caseband 4 is arranged an active display arrangement 36. By active display arrangement, there is understood an optical device comprising a set of elementary cells capable of furnishing light. By an appropriate control of the set of such elementary cells, it is possible to form an image containing a certain quantity of information on the surface of such active display arrangement.

Under crystal 8 is arranged a flat diffracting lens 38 and a flat diffracting mirror 40 is arranged in the back cover of watch 31. By diffracting mirror there is understood a diffracting optical element used in reflection. Again, mirror 40 is arranged so as to reflect light coming from the active display arrangement 36 in the direction of lens 38. Here it will be noted that the light sent by the active display arrangement 36 is substantially monochromatic.

By way of example, the active display arrangement 36 is formed by a set of light emitting diodes or by a set of integrated micro-lasers. The manufacture of the diffracting mirror 40 and the diffracting lens 38 are known to persons skilled in the art. In order to obtain an optimum optical quality of the virtual image of the active surface 46 of the active display 36 received by the eye of a user, mirror 40 and lens 38 can be micro-machined so as to eliminate basically all optical aberration. The profile of the micro-machining of surface 42 of mirror 40 and surface 44 of lens 38 can be programmed with the help of an optical design algorithm known to persons skilled in the art.

The optical arrangement according to this second embodiment of the invention also enables obtaining relatively substantial enlargements of the active surface 46. Thereby, the density of information formed at such active surface 46 can be relatively high, which enables diminishing considerably the dimensions of the active surface 46 for a certain given quantity of information. By way of example, active surface 46 is defined by a square of 25 $mm^2$ within which is arranged a matrix of pixels serving for the formation of the design defining information for the user of watch 31.

With a square matrix formed by 100 times 100 elementary cells, it is possible to produce a text of 10 lines each having a length of about 15 characters. Each elementary cell defines an elementary information point or a pixel. As has been mentioned in the introduction to the present invention description, it is necessary to enlarge the active surface 46 by a factor of about four in order to permit easy reading of the text displayed by such an active display arrangement 36, that is to say, in order that a person can read it at a distance of about 20 cm with no particular accommodation effort.

As has been mentioned in the description of the first embodiment, such an enlargement is possible without further with the optical arrangement according to the invention. For an optical distance of about 15 mm between the display arrangement 36 and lens 38, a virtual image formed by lens 38, corresponding to an enlargement by a factor of four of the active surface 46, is virtually located at an optical distance from lens 38 of about 6 cm. Thereby, it is possible to provide that the surface of lens 38 is less than the surface of the virtual image. In admitting that the eye of a user is located at about 20 cm from the virtual image formed by lens 38, an enlargement by a factor of four corresponds approximately to a virtual image of 4 $cm^2$ for an active surface 46 having 25 $mm^2$. However, given the relatively large separation of the virtual image relative to lens 38, it is possible for a user of the watch 31 to see the entire set of information provided by the active display arrangement 36 through an enlarging lens 38 having a squared surface of 1 $cm^2$. To do so, such user must cause the watch 31 to undergo various displacements relative to the position of his eyes.

Here it will be noted that in the case of a wristwatch worn on the wrist, only a rotational movement according to the longitudinal axis defined by the forearm of the user of the watch 31 can be easily made. Thus, as has already been mentioned in the first embodiment, it is possible to provide a mirror 40 and a lens 38, each exhibiting a profile having a plane of symmetry parallel to the longitudinal axis of the forearm of the user. Hereby, in a manner analogous to a cylindrical mirror and a cylindrical lens, only the dimension transversal to the longitudinal axis of the forearm of the user is enlarged. In such a case, given the configuration of watch 31, the active surface 46 of the active display arrangement 36 is rectangular just as surface 42 of mirror 40 and surface 44 of enlarging lens 38. The design formed on the active surface 46, in particular a text, is compressed only along the small dimension of the active rectangular surface 46. Thus, the virtual image received by the eye of a user exhibits dimensions appropriate, in particular for the writing of texts. By way of example, the active surface 46 has a width of 5 mm and a length of 2 cm, while the surface 44 of the enlarging lens 318 has a width of 1 cm and a length of 2 cm. Continuing by way of example, the enlargement factor of the enlarged dimension has a value comprised between two and five.

It will be noted that in a variant embodiment, the flat mirror 40 can be arranged in an oblique manner relative to the back cover 6 of watch 31, so as to reflect light coming from the active display arrangement 36 towards the enlarging lens 38 in a direction substantially perpendicular to crystal 8.

Figure 4:
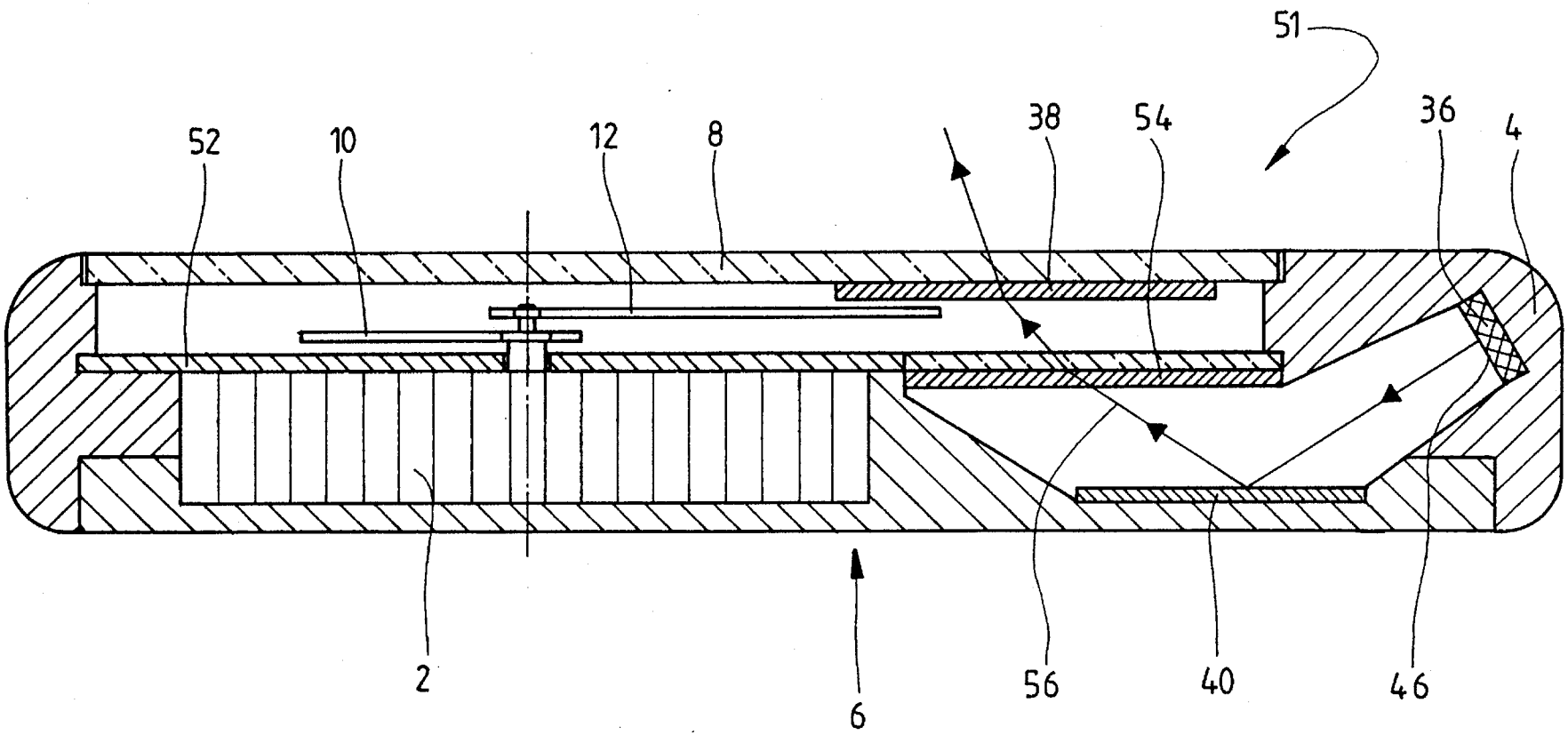
FIG. 4 is a schematic cross-section view of a watch according to a third embodiment of the invention.

Referring hereinafter to FIG. 4, there will be described a third embodiment of a watch according to the invention. Watch 51 comprises a crystal 8, a caseband 4 and a back cover 6. Such watch 51 is fitted with an horological movement 2 associated with an analog display comprising an hours hand 10 and a minutes hand 12 arranged between crystal 8 and a dial 52.

According to the invention, watch 51 comprises an active display arrangement 36 capable of sending light in the direction of a first flat mirror 40. This latter reflects the light coming from arrangement 36 in the direction of a flat diffracting lens 54 located at the level of dial 52 and arranged between mirror 40 and the flat diffracting lens 38 located at the level of crystal 8.

Lens 54 can, together with lens 38, participate in the enlargement of the active surface 46 of the arrangement 36. The lens 54 basically serves to increase the optical quality of the virtual image of the active surface 46 of the arrangement 36.

According to the variant shown on FIG. 4, lens 54 is arranged so that the light coming from mirror 40 is diffracted along a direction slightly angularly shifted relative to the direction of the light between mirror 40 and lens 54. Likewise, the diffracting lens 38 is arranged so as to change the direction of propagation of the light which traverses it so that the angular separation between the direction of the light coming out of the watch 51 and the direction perpendicular to crystal 8 is substantially less than the angular separation between such direction and the direction of the light reflected by mirror 40.

It will be noted that lens 54 can be glued below or above dial 52. Next, in a variant of the embodiment, the lens 54 can be directly machined in dial 52. Likewise, the enlarging lens 38 can be either glued under crystal 8 or directly machined in such crystal 8 in order to form therewith a single common piece.

It will be further noted that mirror 40 is constituted in a variant of the embodiment by a simple standard planar mirror. Again, mirror 40 can be arranged so as to be inclined relative to the back cover 6 of watch 51. As is well understood, the various optical elements are arranged in each of the embodiments in a manner to define the optimum optical path 56 for light coming from the display arrangement provided in the watch according to the invention. The use of flat lenses and flat mirrors diminishes the space occupied by the optical arrangement of the invention and increases the number of degrees of freedom for the arrangement of the various optical elements constituting the optical arrangement according to the invention. It will also be noted that the flat mirror 40 can be a diffracting mirror participating in the enlarging function of the active surface 40 of the active display arrangement 36 and/or to reflect the light according to an angle other than the refraction angle.

Figure 5:
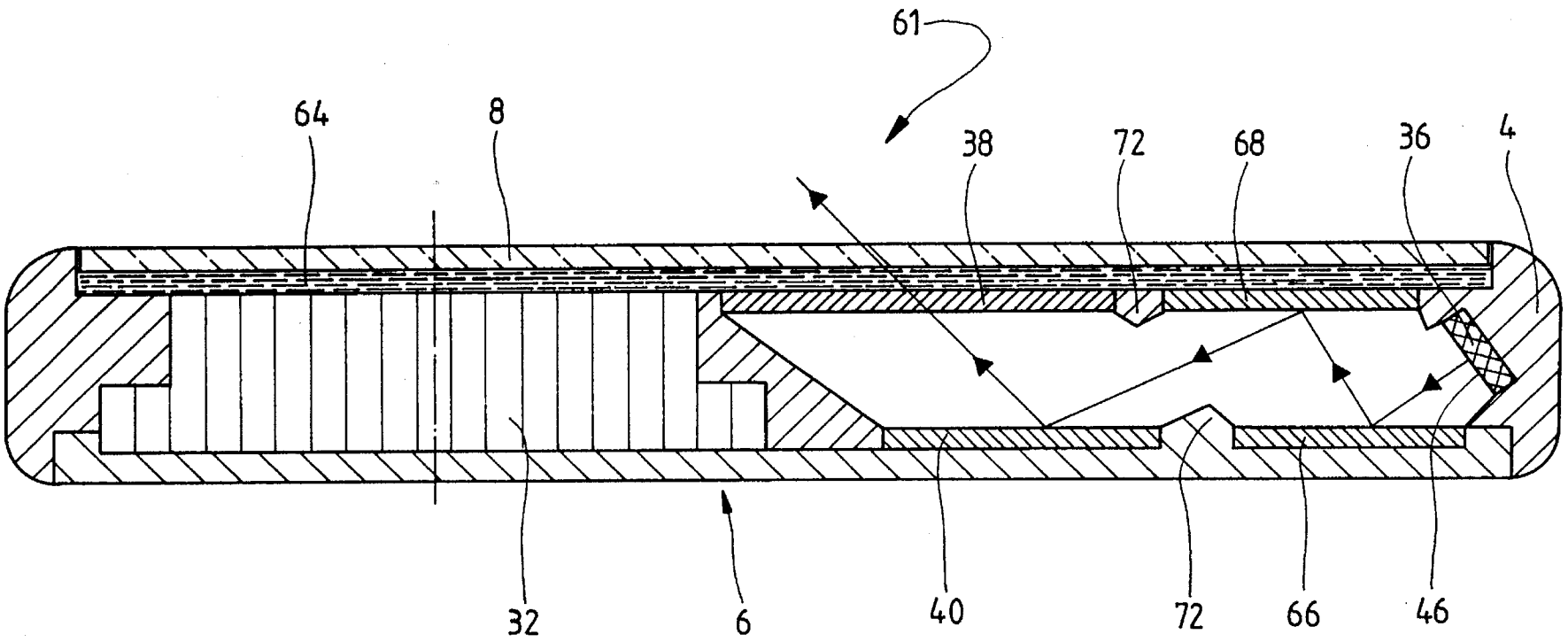
FIG. 5 is a schematic cross-section view of a watch according to a fourth embodiment of the invention.

Referring hereinafter to FIG. 5, there will be described a fourth embodiment of a watch according to the invention.

Watch 61 comprises a crystal 8, a caseband 4 and a back cover 6. It is fitted with an horological movement 32 associated with a liquid crystal display 64.

According to the invention, watch 61 comprises on the interior of case 4 an active display arrangement 36 capable of sending light in the direction of a first mirror 66, which reflects such light in the direction of a second mirror 68 which in turn reflects such light in the direction of a flat diffracting mirror 40. Finally, such mirror 40 reflects the light coming from the arrangement 36 in the direction of a flat diffracting lens 38 arranged below the liquid crystal display arrangement 64 relative to crystal 8.

The first mirror 66 and the flat diffracting mirror 40 are both arranged in the back cover 6, while the second mirror 68 is arranged directly below the liquid crystal display arrangement 64. The light furnished by the active display arrangement 36 thus follows an optical path in zigzag before traversing the enlarging lens 38 and then emerge from the case of watch 61.

Mirrors 66 and 68 can be formed either as standard refracting mirrors or as diffracting mirrors. Such an optical arrangement enables increasing considerably the optical distance between the active display arrangement 36 and the enlarging lens 38. Additionally, the optical arrangement described in this embodiment increases the number of degrees of freedom in the layout of each of the optical elements 66, 68, 40 and 38, thus permitting optimization of the transmission of light coming from the arrangement 36 in order to form an enlarged virtual image of the active surface 46 of the display arrangement 36.

The liquid crystal display arrangement 64 is chosen in a manner such that it is transparent for the wave length of the light coming from the arrangement 36, which sends substantially monochromatic light. Thereby, it is possible to superpose a first design formed by the liquid crystal display arrangement 64 and a second design furnished by the active display arrangement 36. In a variant of the embodiment, the arrangement 64 is transparent for light coming from the arrangement 36 when arrangement 64 is not activated. Again, mirrors 40, 66 and 68 can be arranged so as to be relatively inclined to the back cover 6 and crystal 8 which are substantially parallel to one another.

It will be further noted that there are provided two internal parts 70 and 72 serving to prevent light reflected by the first mirror 66 from going out directly through the enlarging lens 38.

What we claim is:

1. A watch comprising a case, display means and optical enlarging means arranged so as to enlarge optically said display means for a user of such watch, a first mirror arranged within said case in order to reflect light, coming from said display means arranged within said case, in the direction of said optical enlarging means, said first mirror being arranged in the region of a back cover of the case and said optical enlarging means comprising a first lens arranged in the region of a crystal of such watch.

2. A watch as set forth in claim 1, wherein said first mirror is an aspherical refracting mirror.

3. A watch as set forth in claim 1, wherein said first mirror is a diffracting optical element used in reflection.

4. A watch as set forth in claim 1, wherein said first lens is a flat diffracting lens.

5. A watch as set forth in claim 1 comprising a dial, said optical enlarging means furthermore comprising a second lens placed at the level of said dial, said first and second lenses being arranged so as to enlarge optically information supplied by said display means.

6. A watch as set forth in claim 1, comprising at least one second mirror arranged facing said back cover of said case so as to reflect said light coming from said display means in the direction of said first mirror.

7. A watch as set forth in claim 1, wherein said display means are formed by a micro-shutter arrangement, such micro-shutter arrangement being illuminated by means of a luminous source arranged within the case of said watch.

8. A watch as set forth in claim 1 wherein said display means are formed by an active display means of high information density.

9. A watch as set forth in claim 8, wherein said active display means are formed by a set of elementary cells, each capable of supplying a luminous signal defining an elementary point of information.

10. A watch as set forth in claim 1 further comprising a liquid crystal display arrangement at least partially superposed onto said optical enlarging means and located between a crystal of the watch and said optical enlarging means, said liquid crystal display arrangement being basically transparent to the light coming from said display means whenever said liquid crystal display means is not activated.

11. A watch as set forth in claim 11 wherein said liquid crystal display arrangement is likewise at least partially transparent to the light coming from said display means whenever said liquid crystal display arrangement is activated.

12. A watch comprising a case, display means and optical enlarging means arranged so as to enlarge optically said display means for a user of such watch, a first mirror arranged within said case in order to reflect light, coming from said display means arranged within said case, in the direction of said optical enlarging means, said first mirror being arranged in the region of the back cover of the case, said optical enlarging means comprising a first lens arranged under the crystal of such watch.

* * * * *